US009080318B2

(12) United States Patent
Yamazaki

(10) Patent No.: US 9,080,318 B2
(45) Date of Patent: Jul. 14, 2015

(54) MOTOR GRADER

(75) Inventor: Eiji Yamazaki, Komatsu (JP)

(73) Assignee: KOMATSU LTD., Tokyo (JP)

( * ) Notice: Subject to any disclaimer, the term of this patent is extended or adjusted under 35 U.S.C. 154(b) by 141 days.

(21) Appl. No.: 13/822,693

(22) PCT Filed: Mar. 28, 2012

(86) PCT No.: PCT/JP2012/058097

§ 371 (c)(1),
(2), (4) Date: Mar. 13, 2013

(87) PCT Pub. No.: WO2012/165014

PCT Pub. Date: Dec. 6, 2012

(65) Prior Publication Data

US 2013/0175064 A1 Jul. 11, 2013

(30) Foreign Application Priority Data

Jun. 1, 2011 (JP) ..... 2011-123780

(51) Int. Cl.
*E02F 3/76* (2006.01)
*E02F 3/84* (2006.01)

(52) U.S. Cl.
CPC ..... *E02F 3/7636* (2013.01); *E02F 3/7645* (2013.01); *E02F 3/844* (2013.01)

(58) Field of Classification Search
CPC ..... E02F 3/764; E02F 3/765; E02F 3/7645; E02F 3/7654
USPC ..... 172/745, 753, 819, 793; 280/781
See application file for complete search history.

(56) References Cited

U.S. PATENT DOCUMENTS

| | | | | | |
|---|---|---|---|---|---|
| 1,547,263 | A | * | 7/1925 | Pomeroy | 180/312 |
| 2,247,982 | A | * | 7/1941 | Arndt | 172/793 |
| 2,655,743 | A | * | 10/1953 | Ross | 172/793 |
| 3,327,413 | A | * | 6/1967 | Brinkmeyer et al. | 172/785 |
| 3,454,110 | A | | 7/1969 | Hanser | |
| 4,807,461 | A | * | 2/1989 | Brimeyer et al. | 172/793 |

(Continued)

FOREIGN PATENT DOCUMENTS

| | | | |
|---|---|---|---|
| CN | 101238253 | A | 8/2008 |
| JP | 50-80203 | U | 7/1975 |
| JP | 50-80207 | U | 7/1975 |

(Continued)

OTHER PUBLICATIONS

The Office Action for the corresponding Chinese application No. 201280002503.1, issued on Aug. 5, 2014.

(Continued)

*Primary Examiner* — Robert Pezzuto
*Assistant Examiner* — Jessica H Lutz
(74) *Attorney, Agent, or Firm* — Global IP Counselors, LLP

(57) ABSTRACT

A motor grader includes a frame, a work implement, a lifter guide, a lifter bracket and a lift cylinder. The lifter guide is joined to the frame and encloses the frame. The lifter bracket encloses the lifter guide. The lift cylinder is attached to the lifter bracket for driving the work implement. The lifter guide includes an annular portion and a first leg portion, the annular portion enclosing an outer periphery of the frame. The first leg portion is continuous to an inner periphery of the annular portion. The first leg portion protrudes from the annular portion in a side view, and the first leg portion is welded at an outer edge to the frame.

12 Claims, 6 Drawing Sheets

(56) References Cited

U.S. PATENT DOCUMENTS

| | | | | |
|---|---|---|---|---|
| 5,741,026 | A * | 4/1998 | Bonnville | 280/781 |
| 2013/0206432 | A1 * | 8/2013 | Staade et al. | 172/789 |

FOREIGN PATENT DOCUMENTS

| | | | |
|---|---|---|---|
| JP | 53-16301 | U | 2/1978 |
| JP | 54-16121 | B2 | 6/1979 |
| JP | 2001-260940 | A | 9/2001 |
| JP | 2010-53641 | A | 3/2010 |
| WO | 2007/015376 | A1 | 2/2007 |

OTHER PUBLICATIONS

International Search Report for PCT/JP2012/058097.

* cited by examiner

MOTOR GRADER

CROSS-REFERENCE TO RELATED APPLICATIONS

This application claims priority to Japanese Patent Application No. 2011-123780 filed on Jun. 1, 2011, the disclosure of which is hereby incorporated herein by reference in its entirety.

TECHNICAL FIELD

The present invention relates to a motor grader including a work implement.

BACKGROUND ART

In general, a motor grader includes a frame, a work implement disposed under the frame, an annular lifter guide attached to the frame and a lift cylinder coupled to the lifter guide and the work implement (see e.g., International Patent Publication No. WO2007/015376).

SUMMARY

Incidentally, in recent years, the weight of the motor grader has tended to be heavier in accordance with widening of the tire width for increasing the work amount and enhancement of the strength of an axle, a rear frame and etc. Therefore, in shifting the vehicle weight on the work implement by largely tilting the work implement for digging a side ditch, the increased vehicle weight is shifted on the lifter guide through a lift cylinder and durability of a joint part between the lifter guide and the frame may be thereby degraded.

The present invention has been produced in view of the aforementioned situation, and it is an object of the present invention to provide a motor grader whereby the joint strength between a lifter guide and a frame can be enhanced.

A motor grader according to a first aspect of the present invention includes a frame; a work implement disposed under the frame; a lifter guide joined to the frame for enclosing the frame; a lifter bracket enclosing the lifter guide; and a lift cylinder attached to the lifter bracket for driving the work implement. The lifter guide includes: an annular portion enclosing an outer periphery of the frame; and a first leg portion that is continued to an inner periphery of the annular portion, protruded from the annular portion in a side view, and joined at an outer edge to the frame.

According to the motor grader of the first aspect of the present invention, the lifter guide includes the first leg portion. Therefore, it is possible to enlarge the joint range (i.e., the welding line length) between the frame and the lifter guide. Therefore, it is possible to enhance the joint strength between the lifter guide and the frame.

A motor grader according to a second aspect of the present invention relates to the first aspect. In the motor grader, the frame includes: an upper plate extended in a vehicle width direction; a lower plate opposed to the upper plate; a first side plate that is extended in an up-and-down direction while being interposed between the upper plate and the lower plate; and a second side plate opposed to the first side plate, the second side plate interposed between the upper plate and the lower plate. In a joint part of the frame for joining the lifter guide, an end-to-end width of each of the upper and lower plates in the vehicle width direction is equivalent to an end-to-end width between a outer side surface of the first side plate and a outer side surface of the second side plate in the vehicle width direction in the vehicle width direction. The outer edge of the first leg portion is joined to a outer side surface of the upper plate, the outer side surface of the first side plate and the outer side surface of the lower plate.

According to the motor grader of the second aspect of the present invention, joint of the first leg portion to the upper and lower plates is implemented by setting the width of each of the upper and lower plates to be equivalent to that between the first side plate and the second side plate. As a result, it is possible to further enlarge the joint range between the frame and the lifter guide. Accordingly, it is possible to further enhance the joint strength between the lifter guide and the frame.

A motor grader according to a third aspect of the present invention relates to the second aspect. In the motor grader, the first side plate includes: a main body plate disposed inwards of one ends of the upper and lower plates in the vehicle width direction; and a reinforcing plate disposed outwards of the main body plate.

According to the motor grader of the third aspect of the present invention, the width of each of the upper and lower plates is set to be equivalent to that between the first side plate and second side plate through the insertion of the reinforcing plate. Therefore, it is possible to not only further enlarge the joint range between the frame and the lifter guide but also enhance the strength of the frame in itself.

A motor grader according to a fourth aspect of the present invention relates to the second aspect. In the motor grader, the first side plate is formed by a main body plate disposed inwards of the one ends of the upper and lower plates in the vehicle width direction. The upper plate includes an upper notch formed in the joint part. The lower plate includes a lower notch formed correspondingly to the upper notch.

According to the motor grader of the fourth aspect of the present invention, it is possible to set the width of each of the upper and lower plates to be equivalent to that between the first side plate and the second side plate by forming the upper notch and the lower notch. Therefore, it is possible to further enlarge the joint range between the frame and the lifter guide, and simultaneously, reduce the weight of the frame in itself.

A motor grader according to a fifth aspect of the present invention relates to one of the second to fourth aspects. In the motor grader, the first leg portion is protruded back and forth from the annular portion in a side view.

According to the motor grader of the fifth aspect of the present invention, it is possible to support the annular portion from the front and rear sides by the first leg portion in a good balance, and simultaneously, further enlarge the joint range between the frame and the lifter guide. Therefore, it is possible to further enhance the joint strength between the lifter guide and the frame.

A motor grader according to a sixth aspect of the present invention relates to one of the second to fifth aspects. In the motor grader, the first leg portion includes: a first upper leg joined to the outer side surface of the upper plate and the outer side surface of the first side plate; and a first lower leg joined to the outer side surface of the first side plate and the outer side surface of the lower plate. The first upper leg and the first lower leg are separated away from each other.

According to the motor grader of the sixth aspect of the present invention, the lifter guide can be rigidly supported by the first upper leg and the first lower leg with respect to the frame configured to pivot up and down. Further, the first upper leg and the first lower leg are separated away from each other. Therefore, it is possible to further inhibit stress from non-uniformly acting on the joint part, compared to the structure that the first upper leg and the first lower leg are uniformly continued. It is thus possible to inhibit stress from non-uniformly acting on the joint part between the frame and the lifter guide, and it is thereby possible to inhibit the joint between the lifter guide and the frame from being damaged or broken.

A motor grader according to a seventh aspect of the present invention relates to the sixth aspect. In the motor grader, a width of the first upper leg and a width of a first lower leg are respectively reduced in proportion to a distance away from the annular portion.

According to the motor grader of the seventh aspect of the present invention, it is possible to inhibit large stress from acting on the first upper leg and the first lower leg by gradually reducing the width of each leg.

A motor grader according to an eighth aspect of the present invention relates to one of the sixth and seventh aspects. In the motor grader, a thickness of the first upper leg and a thickness of the first lower leg are respectively reduced in proportion to a distance away from the annular portion.

According to the motor grader of the eighth aspect of the present invention, it is possible to inhibit large stress from acting on the first upper leg and the first lower leg by gradually reducing the thickness of each leg.

A motor grader according to a ninth aspect of the present invention relates to one of the first to eighth aspects. In the motor grader, the lifter guide includes a second leg portion that is continued to the inner periphery of the annular portion, protruded from the annular portion in a side view, and joined at an outer edge to the frame. The second leg portion is disposed on an opposite side of the first leg portion through the frame.

According to the motor grader of the ninth aspect of the present invention, it is possible to support the annular portion from the right and left sides by the first leg portion and the second leg portion in a good balance, and simultaneously, further enlarge the joint range between the frame and the lifter guide. Therefore, it is possible to further enhance the joint strength between the lifter guide and the frame.

A motor grader according to a tenth aspect of the present invention relates to the ninth aspect. In the motor grader, the second leg portion is protruded back and forth from the annular portion in a side view.

According to the motor grader of the tenth aspect of the present invention, it is possible to support the annular portion from the front and rear sides by the second leg portion in a good balance, and simultaneously, further enlarge the joint range between the frame and the lifter guide. Therefore, it is possible to further enhance the joint strength between the lifter guide and the frame.

A motor grader according to an eleventh aspect of the present invention relates to one of the ninth and tenth aspects. In the motor grader, the second leg portion includes: a second upper leg joined to the outer side surface of the upper plate and the outer side surface of the second side plate; and a second lower leg joined to the outer side surface of the second side plate and the outer side surface of the lower plate. The second upper leg and the second lower leg are separated away from each other.

According to the motor grader of the eleventh aspect of the present invention, it is possible to further inhibit stress from non-uniformly acting on the joint part between the frame and the lifter guide. Therefore, it is possible to further inhibit the joint between the lifter guide and the frame from being damaged or broken.

A motor grader according to a twelfth aspect of the present invention relates to the eleventh aspect. In the motor grader, a width of the second upper leg and a width of the second lower leg are respectively reduced in proportion to a distance away from the annular portion.

According to the motor grader of the twelfth aspect of the present invention, it is possible to inhibit large stress from acting on the second upper leg and the second lower leg by gradually reducing the width of each leg.

A motor grader according to a thirteenth aspect of the present invention relates to one of the eleventh and twelfth aspects. In the motor grader, a thickness of the second upper leg and a thickness of the second lower leg are respectively reduced in proportion to a distance from the annular portion. According to the motor grader of the thirteenth aspect of the present invention, it is possible to inhibit large stress from acting on the second upper leg and the second lower leg by gradually reducing the thickness of each leg.

According to the present invention, it is possible to provide a motor grader whereby the joint strength between a lifter guide and a frame can be enhanced.

DESCRIPTION OF THE EMBODIMENTS

Overall Structure of Motor Grader 100

Figure 1:
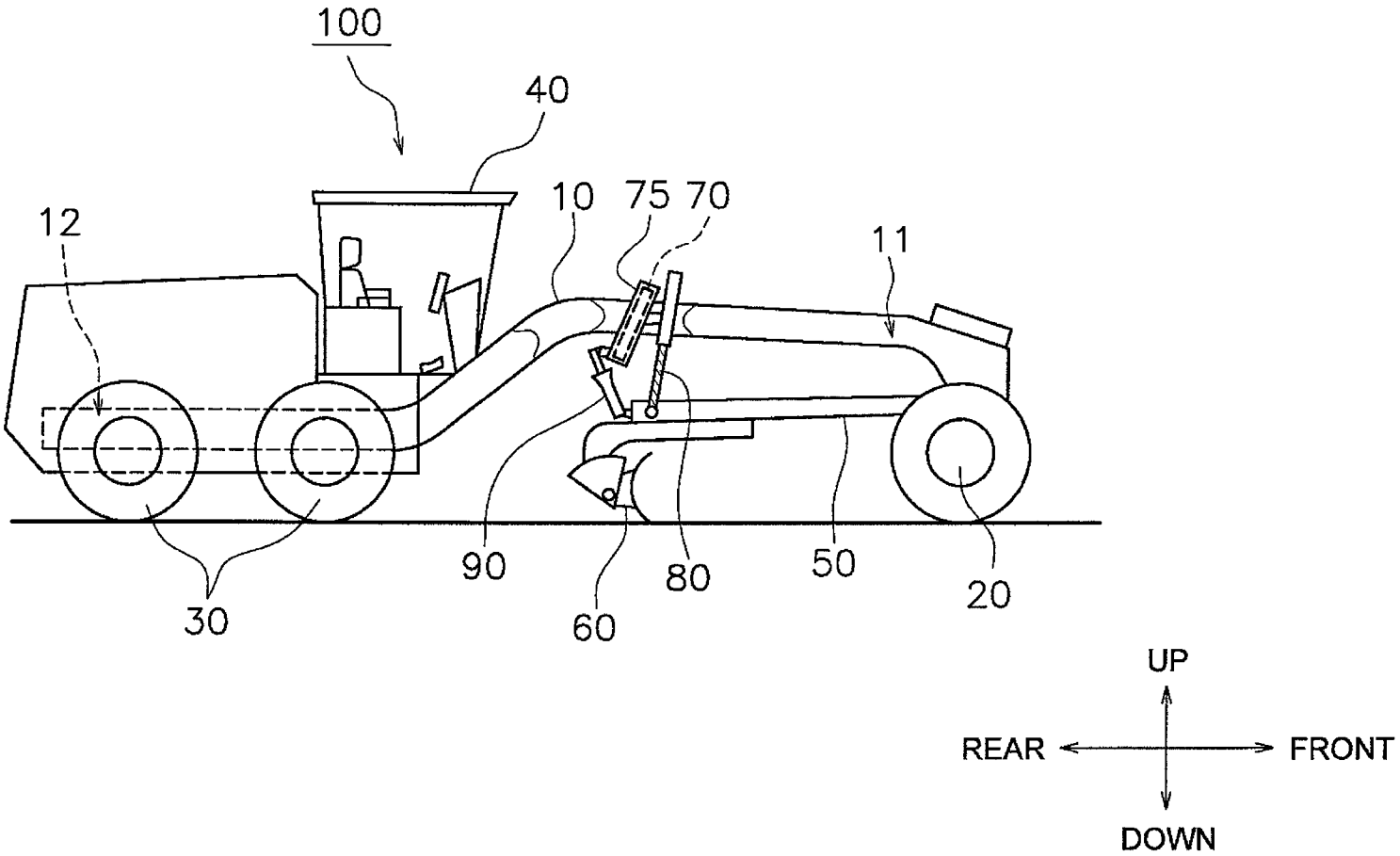
FIG. 1 is a side view illustrating the entire structure of a motor grader.

FIG. 1 is a side view illustrating the entire structure of a motor grader 100 according to an exemplary embodiment. It should be noted in the following explanation that "up", "down", "left", "right", "front" and "rear" are terms based on an operator seated on an operator's seat.

As illustrated in FIG. 1, the motor grader 100 includes a frame 10, a front wheel 20, a rear wheel 30, a cab 40, a drawbar 50, a blade 60, a lifter guide 70, a lifter bracket 75, a pair of lift cylinders 80 and a shift cylinder 90.

The frame 10 is formed by a front frame 11 and a rear frame 12. The front frame 11 supports the drawbar 50 and the blade 60. The rear frame 12 supports an engine, a hydraulic pump and etc. (not illustrated in the figures). The front wheel 20 is attached to the front end portion of the frame 10. The rear wheel 30 is attached to the rear end portion of the frame 10. In the present exemplary embodiment, the front wheel 20 includes a pair of right and left travel wheels while the rear wheel 30 includes two pairs of right and left travel wheels. However, the configurations of the front and rear wheels 20 and 30 are not limited to the above. The cab 40 is disposed on the frame 10.

The drawbar 50 is attached to the front end portion of the frame 10 while being pivotable up and down. The blade 60 is fixed to the rear end portion of the drawbar 50. The lifter guide 70 is an annular member to be joined (welded) to the frame 10. The lifter bracket 75 is a frame enclosing the lifter guide 70. A pair of lift cylinders 80 and the shift cylinder 90 are attached to the lifter bracket 75. The structure of the lifter guide 70 and its periphery will be explained below. It should be noted in the present exemplary embodiment that the drawbar 50 and the blade 60 form a work implement to be disposed under the frame 10.

The pair of lift cylinders 80 (FIG. 1 illustrates only the right lift cylinder) is coupled to the drawbar 50 and the lifter bracket 75. The drawbar 50 and the blade 60 are configured to be pivoted up and down in conjunction with extension/contraction of the pair of lift cylinders 80. The shift cylinder 90 is coupled to the drawbar 50 and the lifter bracket 75. The drawbar 50 and the blade 60 are configured to be driven right and left in conjunction with extension/contraction of the shift cylinder 90.

Structure of Lifter Guide 70 and its Periphery

Figure 2:
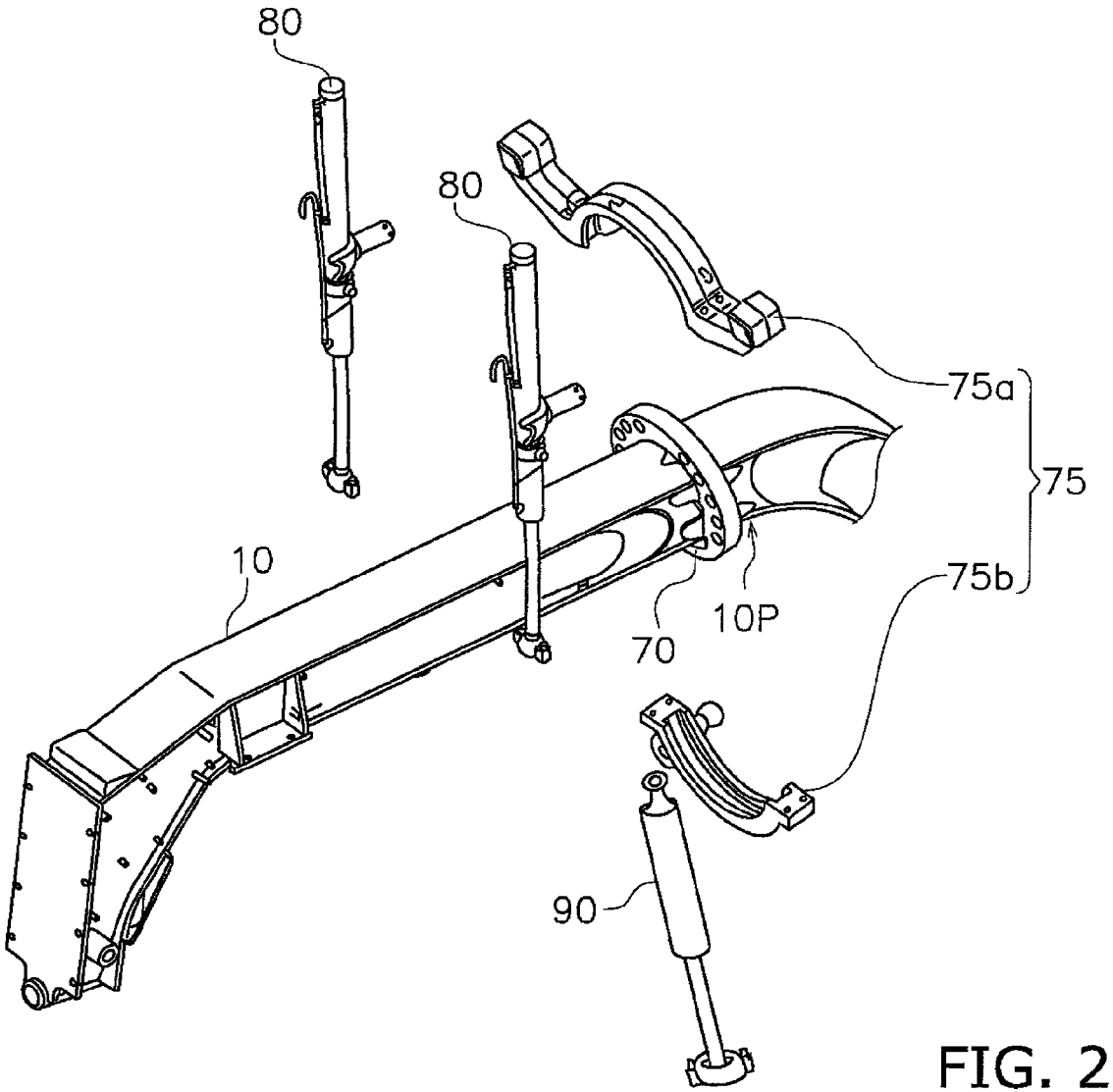
FIG. 2 is an exploded perspective view illustrating the structure of a lifter guide and its periphery.

FIG. 2 is an exploded perspective view illustrating the structure of the lifter guide 70 and its periphery.

The lifter guide 70 is joined to a predetermined position of the frame 10. In FIG. 2, a part of the frame 10, to which the lifter guide 70 is joined, is illustrated as a joint part 10P. The joint structure between the frame 10 and the lifter guide 70 will be hereinafter explained.

The lifter bracket 75 includes an upper frame 75*a* and a lower frame 75*b*. Each of the upper frame 75*a* and the lower frame 75*b* is formed in a semi-annular shape. The upper frame 75*a* and the lower frame 75*b* are coupled to each other while interposing the lifter guide 70 therebetween. The pair of lift cylinders 80 is attached to the upper frame 75*a*, while the shift cylinder 90 is attached to the lower frame 75*b*.

Joint Structure Between Frame 10 and Lifter Guide 70

Figure 3:
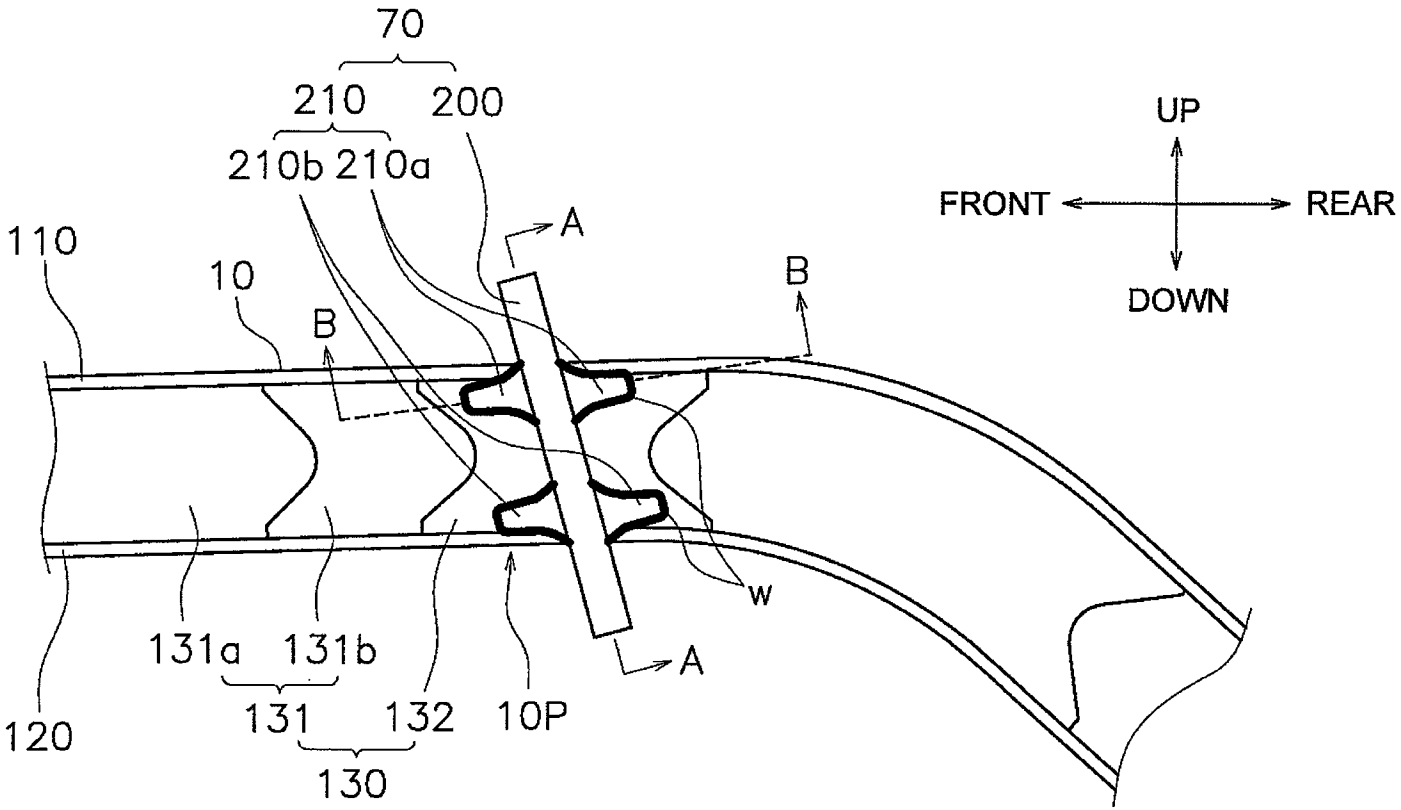
FIG. 3 is a side view of a joint part between a frame and the lifter guide.
Figure 4:
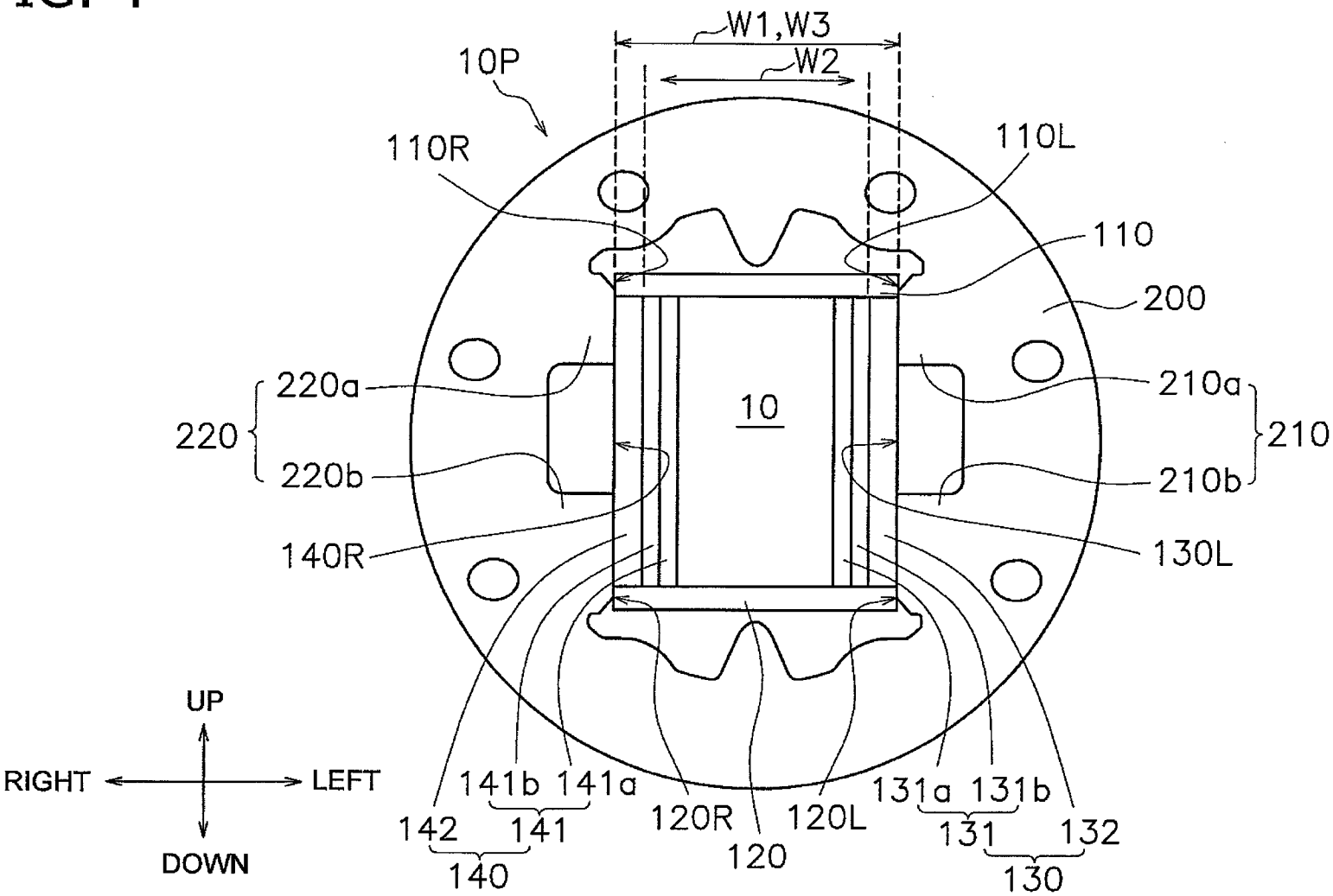
FIG. 4 is a cross-sectional view of FIG. 3 sectioned along a line A-A.
Figure 5:
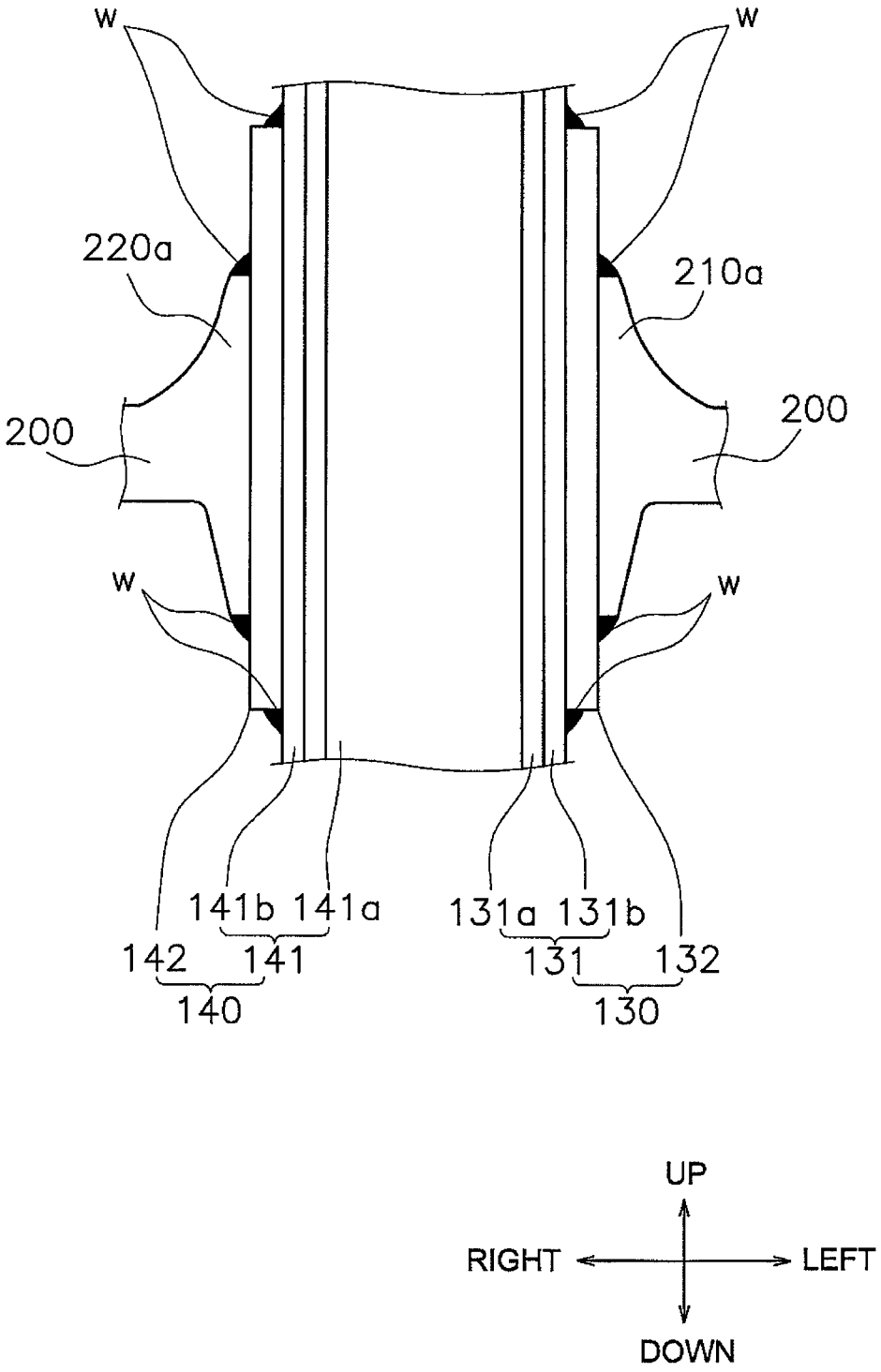
FIG. 5 is a cross-sectional view of FIG. 3 sectioned along a line B-B.

FIG. 3 is a side view of the joint part 10P. FIG. 4 is a cross-sectional view of FIG. 3 sectioned along a line A-A. FIG. 5 is a cross-sectional view of FIG. 3 sectioned along a line B-B. FIGS. 3 and 5 illustrate a welded part w for joining the frame 10 and the lifter guide 70. The welded part w is so-called a bead.

(1) Structure of Frame 10

As illustrated in FIGS. 3 to 5, the frame 10 is formed by an upper plate 110, a lower plate 120, a first side plate 130 and a second side plate 140.

The upper plate 110 is extended in the vehicle width direction (i.e., a right-and-left direction) while being disposed roughly in parallel to the vehicle width direction. The upper plate 110 has a width W1 in the vehicle width direction.

The lower plate 120 is extended in the vehicle width direction while being opposed to the upper plate 110. The lower plate 120 has the width direction W1, which is the same as the width of the upper plate 110, in the vehicle width direction.

The first side plate 130 is interposed between the upper plate 110 and the lower plate 120. The first side plate 130 is formed by a first main body plate 131 and a first reinforcing plate 132. The first main body plate 131 is extended in the up-and-down direction while being disposed roughly in parallel to the up-and-down direction. The first main body plate 131 is disposed inwards of the left end of the upper plate 110 and that of the lower plate 120 in the vehicle width direction. The first main body plate 131 includes an inner plate 131*a* and an outer plate 131*b*. The outer plate 131*b* is a member disposed on the principal surface of the inner plate 131*a* for achieving sufficient strength of a curved part of the frame 10. The first reinforcing plate 132 is a member disposed on the principal surface of the first main body plate 131 for enhancing joint strength between the frame 10 and the lifter guide 70.

The second side plate 140 is interposed between the upper plate 110 and the lower plate 120. The second side plate 140 is formed by a second main body plate 141 and a second reinforcing plate 142. The second main body plate 141 is extended in the up-and-down direction while being opposed to the first main body plate 131. The second main body plate 141 is disposed inwards of the right end of the upper plate 110 and that of the lower plate 120 in the vehicle width direction. The second main body plate 141 includes an inner plate 141*a* and an outer plate 141*b*. The outer plate 141*b* is a member disposed on the principal surface of the inner plate 141*a* for achieving sufficient strength of the curved part of the frame 10. The second reinforcing plate 142 is a member disposed on the principal surface of the second main body plate 141 for enhancing joint strength between the frame 10 and the lifter guide 70.

A width W2 between the left end of the first main body plate 131 and the right end of the second main body plate 141 in the vehicle width direction is herein less than the width W1 of the upper plate 110 and the lower plate 120.

On the other hand, a width W3 between the left end of the first side plate 130 and the right end of the second side plate 140 in the vehicle width direction is equivalent to the width W1 of the upper plate 110 and the lower plate 120.

Therefore, a left outer side surface 110L of the upper plate 110, a left outer side surface 130L of the first side plate 130 and a left outer side surface 120L of the lower plate 120 forms a plane extended in the up-and-down direction while being arranged on the same plane. Further, a right outer side surface 110R of the upper plate 110, a right outer side surface 140R of the first side plate 140 and a right outer side surface 120R of the lower plate 120 forms a plane extended in the up-and-down direction while being arranged on the same plane.

(2) Structure of Lifter Guide 70

As illustrated in FIGS. 3 to 5, the lifter guide 70 is formed by an annular portion 200, a left leg portion 210 and a right leg portion 220.

The annular portion 200 encloses the outer periphery of the frame 10 (the joint part 10P). The annular portion 200 includes a plurality of apertures for changing the fixation position of the lifter bracket 75.

The left leg portion 210 is continued to the inner periphery of the annular portion, while being protruded back and forth from the annular portion 200 in a left side view as illustrated in FIG. 3. The left leg portion 210 includes a first upper leg 210*a* and a first lower leg 210*b*. The first upper leg 210*a* and the first lower leg 210*b* are disposed inside the annular portion 200 while being extended along the frame 10 in the back-and-forth direction. The outer edge of the first upper leg 210*a* and that of the first lower leg 210*b* are welded to the frame 10. More specifically, the outer edge of the first upper leg 210*a* is joined to the left outer side surface 110L of the upper plate 110 and the left outer side surface 130L of the first side plate 130 through the welded part w. Likewise, the outer edge of the first lower leg 210*b* is joined to the left outer side surface 130L of the first side plate 130 and the left outer side surface 120L of the lower plate 120 through the welded part w. Thus, the outer edge of the left leg portion 210 is welded not only to the first side plate 130 but also to the upper plate 110 and the lower plate 120. It should be noted that the first upper leg 210*a* and the first lower leg 210*b* are separated away from each other in the up-and-down direction as illustrated in FIG. 4.

Further, the right leg portion 220 is continued to the inner periphery of the annular portion. Although not illustrated in the figures, the right leg portion 220 is protruded back and forth from the annular portion 200 in a right side view. Similarly to the left leg portion 210, the right leg portion 220 includes a second upper leg 220*a* and a second lower leg 220*b*. The second upper leg 220*a* and the second lower leg 220*b* are disposed inside the annular portion 200, while being extended along the frame 10 in the back-and-forth direction. The outer edge of the first upper leg 210*a* and that of the first lower leg 210*b* are welded to the frame 10. More specifically, the outer edge of the second upper leg 220*a* is joined to the right outer side surface 110R of the upper plate 110 and a right outer side surface 140R of the second side plate 140 through the welded part w. Likewise, the outer edge of the second lower leg 220*b* is joined to the right outer side surface 140R of the second side plate 140 and the right outer side surface 120R of the lower plate 120 through the welded part w. Thus, the second upper leg 220*a* and the second lower leg 220*b* are welded not only to the second side plate 140 but also to the upper plate 110 and the lower plate 120. It should be noted that the second upper leg 220*a* and the second lower leg 220*b* are separated away from each other in the up-and-down direction as illustrated in FIG. 4.

As illustrated in FIG. 3, the width of the first upper leg 210*a* of the left leg portion 210 and that of the first lower leg 210*b* of the left leg portion 210 are herein respectively reduced in proportion to distance away from the annular portion 200. In other words, each of the first upper leg 210*a* and the first lower leg 210*b* is formed in a tapered shape in a direction away from the annular portion 200 in a side view. This is also true of the second upper leg 220*a* and the second lower leg 220*b* of the right leg portion 220 although not illustrated in the figures.

Further as illustrated in FIG. 5, the thickness of the first upper leg 210*a* of the left leg portion 210 and that of the second upper leg 220*a* of the right leg portion 220 are respectively reduced in proportion to distance away from the annular portion 200. In other words, each of the first upper leg 210*a* and the second upper leg 220*a* is formed in a tapered shape in a direction away from the annular portion 200 in a cross-section. This is also true of the first lower leg 210*b* of the left leg portion 210 and the second lower leg 220*b* of the right leg portion 220 although not illustrated in the figures.

Actions and Effects (1) The lifter guide 70 according to the exemplary embodiment includes the annular portion 200 and the left leg portion 210 (an exemplary "first leg portion"). The annular portion 200 encloses the outer periphery of the frame 10. The left leg portion 210 is continued to the inner periphery of the annular portion 200 while being protruded from the annular portion 200 in a side view. Further, the left leg portion 210 is joined at the outer edge thereof to the frame 10.

Thus, the lifter guide 70 includes the left leg portion 210 and the right leg portion 220. It is thereby possible to extend the joint range between the frame 10 and the lifter guide 70 (i.e., the welding line length of the welded part w). Therefore, it is possible to enhance the joint strength between the lifter guide 70 and the frame 10.

(2) In the joint part 10P, i.e., a region of the frame 10 to which the lifter guide 70 is joined, the width W1 of the upper plate 110 and the lower plate 120 and the width W3 of the first side plate 130 and the second side plate 140 are equivalent to each other. The outer edge of the left leg portion 210 is joined to the left outer side surface 110L of the upper plate 110, the left outer side surface 130L of the first side plate 130 and the left outer side surface 120L of the lower plate 120.

Thus, joint of the left leg portion 210 to the upper plate 110 and the lower plate 120 is implemented by setting the width W1 of the upper plate 110 and the lower plate 120 and the width W3 of the first side plate 130 and the second side plate 140 to be equivalent to each other. As a result, it is possible to further enlarge the joint range between the frame 10 and the lifter guide 70. It is thereby possible to further enhance the joint strength between the lifter guide 70 and the frame 10.

It should be noted that the aforementioned effect can be also similarly obtained by the right leg portion 220.

(3) The first side plate 130 is formed by the first main body plate 131 and the first reinforcing plate 132.

Thus, through the insertion of the first reinforcing plate 132, the width W1 of the upper plate 110 and the lower plate 120 and the width W3 of the first side plate 130 and the second side plate 140 are set to be equivalent to each other. Therefore, it is possible to not only further enlarge the joint range as described above but also enhance strength of the frame 10 in itself.

It should be noted that the aforementioned effect can be also similarly obtained by the structure of the second side plate 140 formed by the second main body plate 141 and the second reinforcing plate 142.

(4) The left leg portion 210 is protruded back and forth from the annular portion 200 in a side view.

Therefore, it is possible to support the annular portion 200 in a good balance from the front and back sides thereof by the left leg portion 210. Simultaneously, it is possible to further enlarge the joint range between the frame 10 and the lifter guide 70. Therefore, it is possible to further enhance the joint strength between the lifter guide 70 and the frame 10.

(5) The left leg portion 210 includes the first upper leg 210*a* and the first lower leg 210*b*, which are separated away from each other.

Therefore, it is possible to rigidly support the lifter guide 70 by the first upper leg 210*a* and the first lower leg 210*b* with respect to the frame 10 pivoting up and down. Further, the first upper leg 210*a* and the first lower leg 210*b* are herein separated away from each other. Therefore, it is possible to further inhibit stress from non-uniformly acting on the joint part between the frame 10 and the lifter guide 70, compared to the case that the first upper leg 210*a* and the first lower leg 210*b* are uniformly continued. Accordingly, it is possible to inhibit degradation of the joint force between the lifter guide 70 and the frame 10.

It should be noted that the aforementioned effect can be also similarly obtained by the structure of the right leg portion 220 including the second upper leg 220*a* and the second lower leg 220*b*, which are separated away from each other.

(6) The width of the first upper leg 210*a* and that of the first lower leg 210*b* are respectively reduced in proportion to distance away from the annular portion 200. It is possible to inhibit large stress from concentrating on a particular position on each of the first upper leg 210*a* and the first lower leg 210*b* by thus gradually reducing the width of each leg.

(7) The thickness of the first upper leg 210*a* and that of the second upper leg 220*a* are respectively reduced in proportion to distance away from the annular portion 200. It is possible to inhibit large stress from concentrating on a particular position on each of the first upper leg 210*a* and the first lower leg 210*b* by thus gradually reducing the thickness of each leg.

Other Exemplary Embodiments

An exemplary embodiment of the present invention has been explained above. However, the present invention is not limited to the aforementioned exemplary embodiment, and a variety of changes can be made without departing from the scope of the present invention.

(A) In the aforementioned exemplary embodiment, the width W1 of the upper plate 110 and the lower plate 120 and the width W3 of the first side plate 130 and the second side plate 140 are set to be equivalent to each other by interposing the first reinforcing plate 132 of the first side plate 130 and the second reinforcing plate 142 of the second side plate 140. However, the present invention is not limited to the above.

Figure 6:
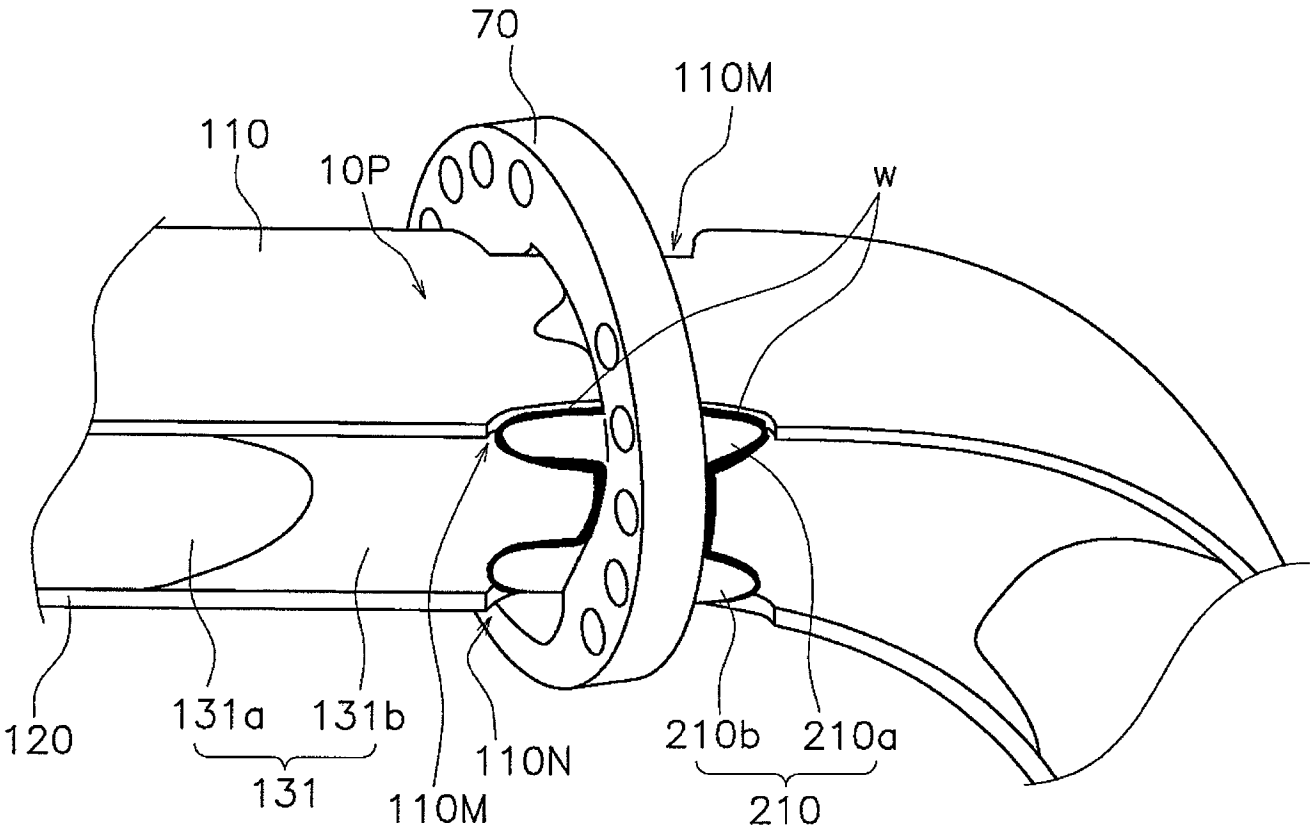
FIG. 6 is a perspective view of the joint part between the frame and the lifter guide.

As illustrated in FIG. 6, when the first side plate 130 is formed by only the first main body plate 131, it is only required to form upper notches 110M in the upper plate 110 and form lower notches 110N in the lower plate 120. Accordingly, it is possible to set the width W1 of the upper plate 110 and the lower plate 120 and the width W3 of the first side plate 130 and the second side plate 140 to be equivalent to each other. As a result, it is possible to arrange the left outer side surface 110L of the upper plate 110, the left outer side surface 130L of the first side plate 130 and the left outer side surface 120L of the lower plate 120 on the same plane. Further, in this case, it is possible to not only further enlarge the joint range but also reduce the weight of the frame 10 in itself. This is similarly true of the second side plate 140 side.

It should be noted that FIG. 6 illustrates the welded parts w for welding the frame 10 and the lifter guide 70.

(B) In the aforementioned exemplary embodiment, the left leg portion 210 is designed to include the first upper leg 210*a* and the first lower leg 210*b*, which are separated away from each other. However, the present invention is not limited to the above. The left leg portion 210 may be formed by a single leg, or alternatively, by a three or more legs. This is similarly true of the right leg portion 220.

(C) In the aforementioned exemplary embodiment, the left leg portion 210 is protruded back and forth from the annular portion 200 in a side view. However, the present invention is not limited to the above. The left leg portion 210 may be protruded only forwards or rearwards of the annular portion 200 in a side view. This is similarly true of the right leg portion 220.

(D) In the aforementioned exemplary embodiment, the lifter guide 70 is designed to include the left leg portion 210 and the right leg portion 220. However, the present invention is not limited to the above. The lifter guide 70 may include only either of the left leg portion 210 and the right leg portion 220.

The motor grader according to the illustrated embodiment can enhance the joint strength between the lifter guide and the frame, and is therefore, useful in the field of construction machines.

The invention claimed is:

1. A motor grader comprising:

a frame including an upper plate, a lower plate, a first side plate and a second side plate, the upper plate extending in a vehicle width direction, the lower plate being opposed to the upper plate, the first side plate extending in an up-and-down direction and being interposed between the upper plate and the lower plate, the second side plate being opposed to the first side plate and interposed between the upper plate and the lower plate;

a work implement disposed under the frame;

a lifter guide joined to the frame, the lifter guide completely enclosing the frame, in a joint part of the frame for joining the lifter guide, an end-to-end width of each of the upper and lower plates in the vehicle width direction being equivalent to an end-to-end width between an outer side surface of the first side plate and an outer side surface of the second side plate in the vehicle width direction;

a lifter bracket enclosing the lifter guide; and a lift cylinder attached to the lifter bracket for driving the work implement, the lifter guide including an annular portion and a first leg portion, the annular portion enclosing an outer periphery of the frame, the first leg portion being continuous to an inner periphery of the annular portion, the first leg portion protruding from the annular portion in a side view, the first leg portion being welded at an outer edge to the frame, and the outer edge of the first leg portion being directly joined to an outer side surface of the upper plate, the outer side surface of the first side plate and the outer side surface of the lower plate.

2. The motor grader according to claim 1, wherein the first side plate includes a main body plate and a reinforcing plate, the main body plate being disposed inwards of an end of the upper and lower plates in the vehicle width direction, the reinforcing plate being disposed outwards of the main body plate.

3. The motor grader according to claim 1, wherein the first side plate is formed by a main body plate disposed inwards of an end of the upper and lower plates in the vehicle width direction, the upper plate includes an upper notch formed in the joint part, and the lower plate includes a lower notch formed correspondingly to the upper notch.

4. The motor grader according to claim 1, wherein the first leg portion protrudes back and forth from the annular portion in a side view.

5. The motor grader according to claim 1, wherein the first leg portion includes a first upper leg and a first lower leg, the first upper leg being joined to the outer side surface of the upper plate and the outer side surface of the first side plate, the first lower leg being joined to the outer side surface of the first side plate and the outer side surface of the lower plate, and the first upper leg and the first lower leg are separated away from each other.

6. The motor grader according to claim 5, wherein a width of the first upper leg and a width of a first lower leg are respectively reduced in proportion to a distance away from the annular portion.

7. The motor grader according to claim 5, wherein a thickness of the first upper leg and a thickness of the first lower leg are respectively reduced in proportion to a distance away from the annular portion.

8. The motor grader according to claim 1, wherein the lifter guide includes a second leg portion, the second leg portion being continuous to the inner periphery of the annular portion, the second leg portion protruding from the annular portion in a side view, the second leg portion being welded at an outer edge to the frame, and the second leg portion is disposed on an opposite side of the first leg portion through the frame.

9. The motor grader according to claim 8, wherein the second leg portion protrudes back and forth from the annular portion in a side view.

10. The motor grader according to claim 8, wherein the second leg portion includes a second upper leg and a second lower leg, the second upper leg being joined to the outer side surface of the upper plate and the outer side surface of the second side plate, the second lower leg being joined to the outer side surface of the second side plate and the outer side surface of the lower plate, and the second upper leg and the second lower leg are separated away from each other.

11. The motor grader according to claim 10, wherein a width of the second upper leg and a width of the second lower leg are respectively reduced in proportion to a distance away from the annular portion.

12. The motor grader according to claim 10, wherein a thickness of the second upper leg and a thickness of the second lower leg are respectively reduced in proportion to a distance from the annular portion.

* * * * *